US007562671B2

(12) United States Patent
Wang

(10) Patent No.: US 7,562,671 B2
(45) Date of Patent: Jul. 21, 2009

(54) AUTO-SWITCHING VALVE CONNECTOR FOR AIR PUMP

(76) Inventor: Lo-Pin Wang, 16F.-2, No. 62, Sec. 2, Chongde 2nd Rd., Betiun District, Taichung City 406 (TW)

( * ) Notice: Subject to any disclaimer, the term of this patent is extended or adjusted under 35 U.S.C. 154(b) by 549 days.

(21) Appl. No.: 11/400,792

(22) Filed: Apr. 10, 2006

(65) Prior Publication Data

US 2007/0235677 A1 Oct. 11, 2007

(51) Int. Cl.
*F16K 15/20* (2006.01)

(52) U.S. Cl. ..... 137/231; 137/223; 137/875; 251/149.2

(58) Field of Classification Search ..... 137/118.01, 137/118.03, 119.01, 223, 231, 875; 251/149.2
See application file for complete search history.

(56) References Cited

U.S. PATENT DOCUMENTS 1,853,723 A * 4/1932 Crowley ..... 251/149.2
1,858,766 A * 5/1932 Dabroski ..... 251/149.2
2,112,417 A * 3/1938 Farmer ..... 251/149.6
2,765,996 A * 10/1956 Anderson ..... 251/149.2
3,923,325 A * 12/1975 Slater, Jr. ..... 137/322
4,005,726 A * 2/1977 Fowler ..... 137/119.01
5,287,841 A * 2/1994 Forsythe et al. ..... 137/118.03
5,645,100 A * 7/1997 Chuang et al. ..... 137/223
5,666,990 A * 9/1997 Wu ..... 137/223
5,749,392 A * 5/1998 Glotin ..... 137/231
5,762,095 A * 6/1998 Gapinski et al. ..... 137/223
5,819,781 A * 10/1998 Wu ..... 137/231
5,873,737 A * 2/1999 Hashizawa et al. ..... 439/39
5,921,269 A * 7/1999 Wu ..... 137/223
5,960,815 A * 10/1999 Wang ..... 137/118.03
5,975,109 A * 11/1999 Wu ..... 137/231
5,983,920 A * 11/1999 Gapinski et al. ..... 137/231
6,073,645 A * 6/2000 Wu ..... 137/231
6,076,544 A * 6/2000 Pierce ..... 137/223
6,102,063 A * 8/2000 Pierce et al. ..... 137/231
6,105,600 A * 8/2000 Wang ..... 137/231
6,105,601 A * 8/2000 Wang ..... 137/231
6,146,116 A * 11/2000 Wu et al. ..... 137/223
6,220,273 B1 * 4/2001 Wu ..... 137/231
6,220,274 B1 * 4/2001 Wang ..... 137/231
6,276,405 B1 * 8/2001 Wang ..... 141/38
6,289,920 B1 * 9/2001 Wang ..... 137/223
6,328,057 B1 * 12/2001 Wang ..... 137/231
6,786,247 B1 * 9/2004 Kemppainen et al. ..... 137/223
6,843,270 B1 * 1/2005 Wang ..... 137/231
6,953,326 B2 * 10/2005 Wang ..... 141/38
7,040,355 B2 * 5/2006 Wu ..... 137/223

(Continued)

*Primary Examiner*—John Rivell
*Assistant Examiner*—Craig Price
(74) *Attorney, Agent, or Firm*—Browdy and Neimark, P.L.L.C.

(57) ABSTRACT

A valve connector of an air pump includes a case with a channel and a guiding room therein. The channel is communicated with the guiding room. Two valve connector assemblies are provided in the case, each of which has a tunnel communicated with the guiding room, wherein the tunnels form apertures on a sidewall of the guiding room. A switching device is received in the guiding room and pivoted on the sidewall of the guiding room. The switching device has two arms on opposite sides of a pivot axle thereof. The arms are moved toward or away from the apertures respectively when the switching device is swung to close or open the apertures.

9 Claims, 6 Drawing Sheets

U.S. PATENT DOCUMENTS

| | | | | |
|---|---|---|---|---|
| 7,093,609 | B2 * | 8/2006 | Chen | 137/231 |
| 7,404,703 | B2 * | 7/2008 | Wang | 417/437 |
| 2003/0221724 | A1 * | 12/2003 | Wang | 137/223 |
| 2003/0234042 | A1 * | 12/2003 | Delorme | 137/231 |
| 2005/0230499 | A1 * | 10/2005 | Wang | 239/390 |
| 2006/0237062 | A1 * | 10/2006 | Matsuzawa et al. | 137/223 |
| 2008/0236675 | A1 * | 10/2008 | Wang | 137/231 |

* cited by examiner

AUTO-SWITCHING VALVE CONNECTOR FOR AIR PUMP

BACKGROUND OF THE INVENTION

1. Field of the Invention

The present invention relates generally to an air pump, and more particularly to a valve connector of the air pump, which may automatically switch the channels for different valves.

2. Description of the Related Art

FIG. 1 shows a conventional valve connector of an air pump, which includes a case 10, in which a main member 18 and two connectors 14 and 15 are provided. The main member 18 has valve room 21 therein, in which an overflow stop member 32 is received. When inflation, air flow will move the overflow stop member 32 to the channel of the connector without connecting the valve to switch the inflating channel automatically.

SUMMARY OF THE INVENTION

The primary objective of the present invention is to provide a valve connector for an air pump with a novel automatic channel switching device.

According to the objective of the present invention, a valve connector of an air pump comprises a case with a channel and a guiding room therein. The channel is communicated with the guiding room. Two valve connector assemblies are provided in the case, each of which has a tunnel communicated with the guiding room, wherein the tunnels form apertures on a sidewall of the guiding room. A switching device is received in the guiding room and pivoted on the sidewall of the guiding room. The switching device has two arms on opposite sides of a pivot axle thereof. The arms are moved toward or away from the apertures respectively when the switching device is swung to close or open the apertures.

DETAILED DESCRIPTION OF THE INVENTION

Figure 2:
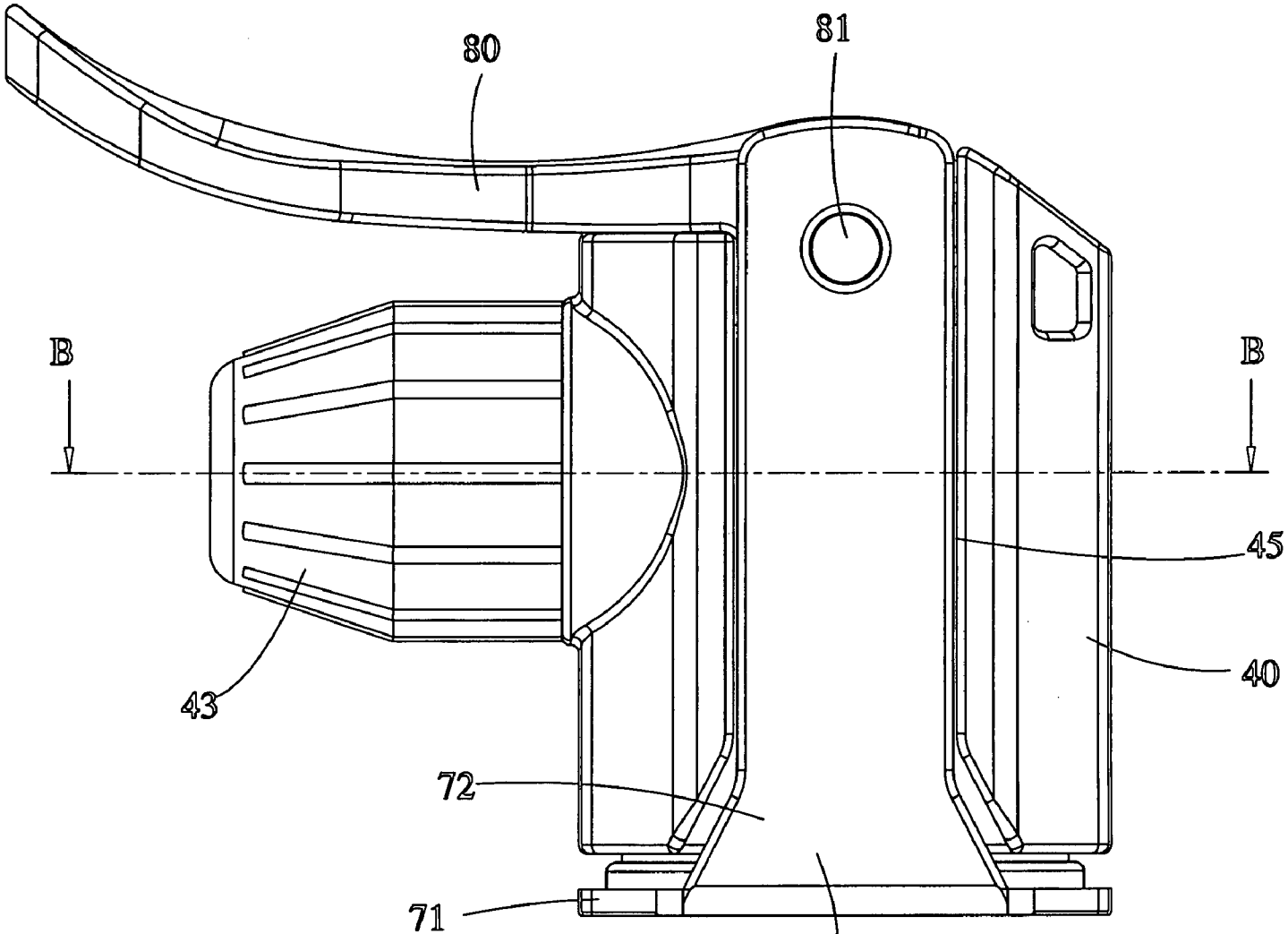
FIG. 2 is a front view of a preferred embodiment of the present invention.
Figure 3:
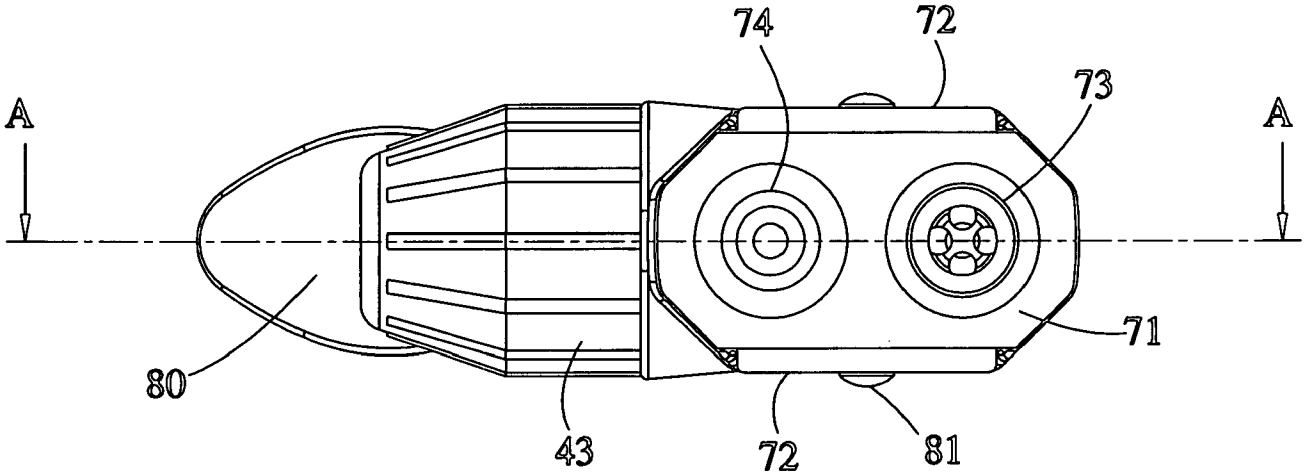
FIG. 3 is a bottom view of the preferred embodiment of the present invention.
Figure 5:
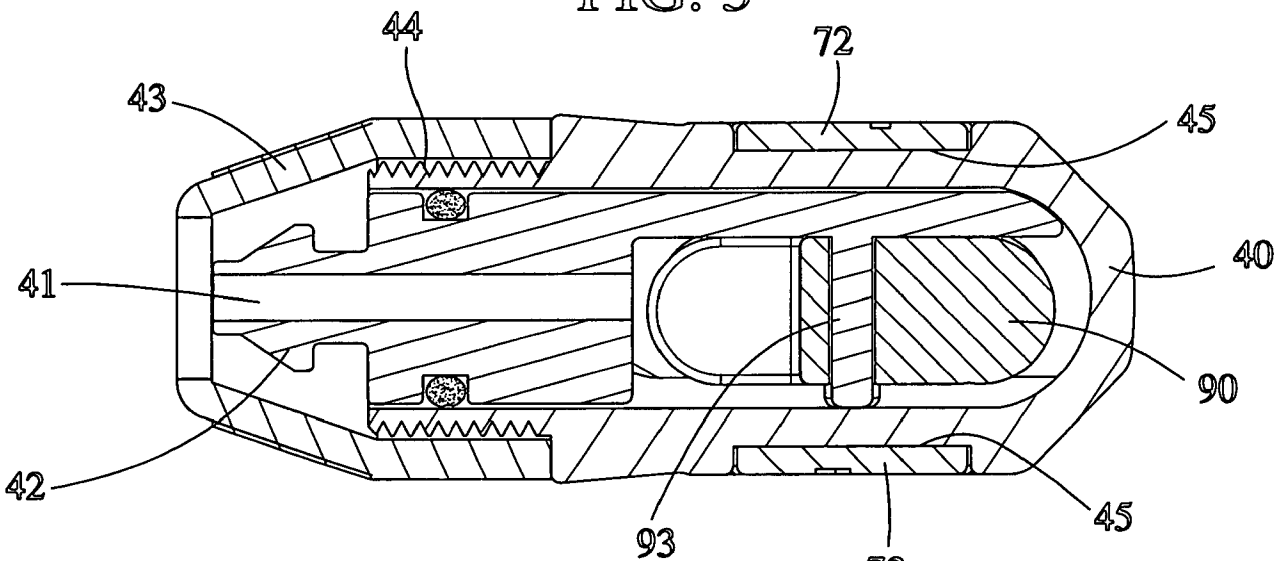
FIG. 5 is a sectional view along B-B line of FIG. 2.

As shown in FIG. 2 and FIG. 5, a valve connector of an air pump of the preferred embodiment of the present invention comprises:

A case 40 includes a channel 41 therein to be connected to a cylinder (not shown) of the air pump. In the present invention, the case 40 has a plug 42 communicated to the channel 41 to be inserted into a hose (not shown) and a cap 43 screwed to a thread 44 on the case 40. The case 40 may be incorporated in the air pump with hose, such as floor pump. The case 40 also may be connected to the air pump without the hose, such as head pump or mini pump.

The case 40 further has a guiding room 46 therein communicated with the channel 41.

Two connector assemblies 50 and 60 are provided in the case 40, each of which has a tunnel 52 and 62 communicated with the guiding room 46. It defines apertures 53 and 63 where ends of the tunnels 52 and 62 are communicated with the guiding room 46.

Figure 4:
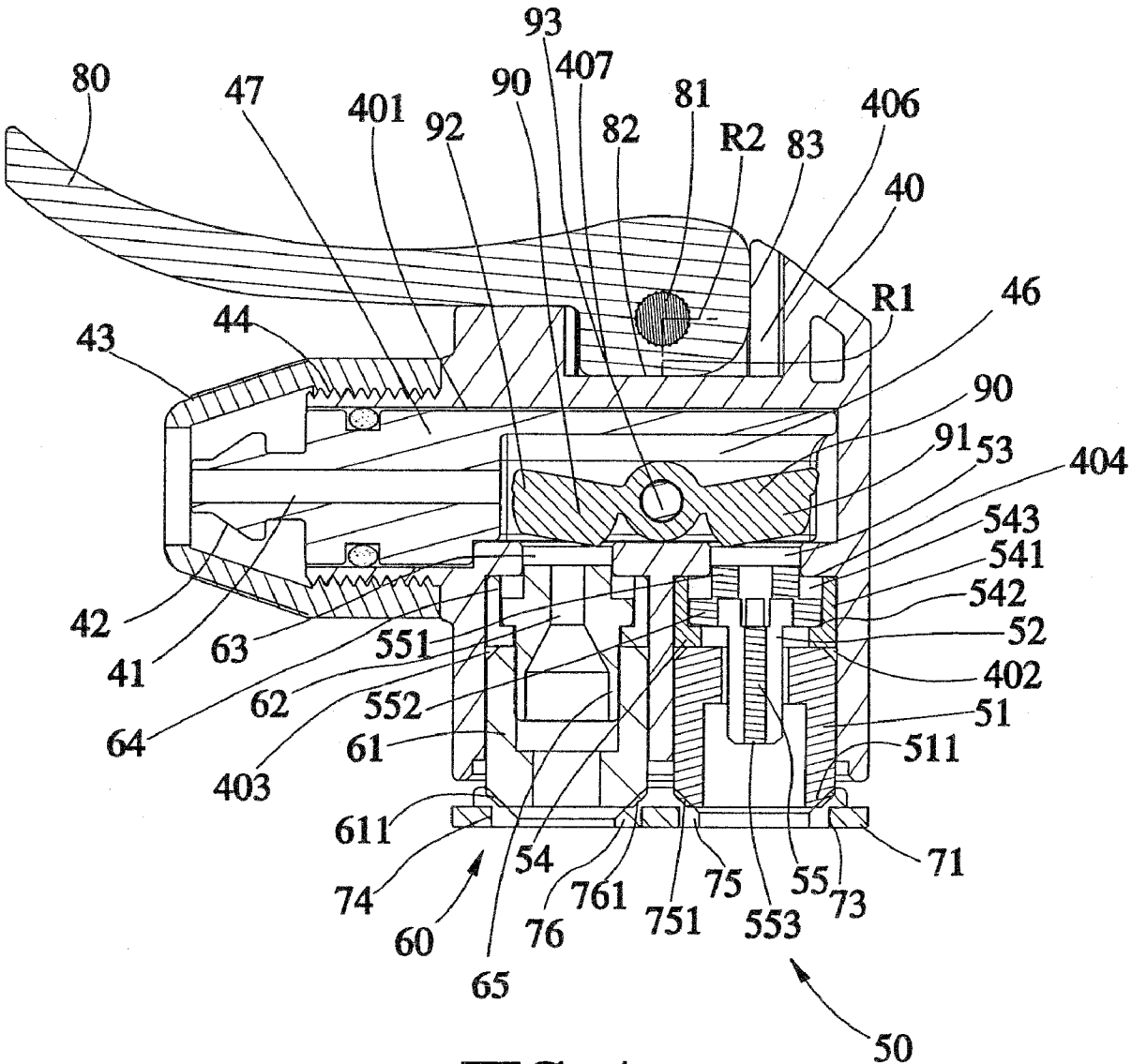
FIG. 4 is a sectional view along A-A line of FIG. 3.
Figure 6:
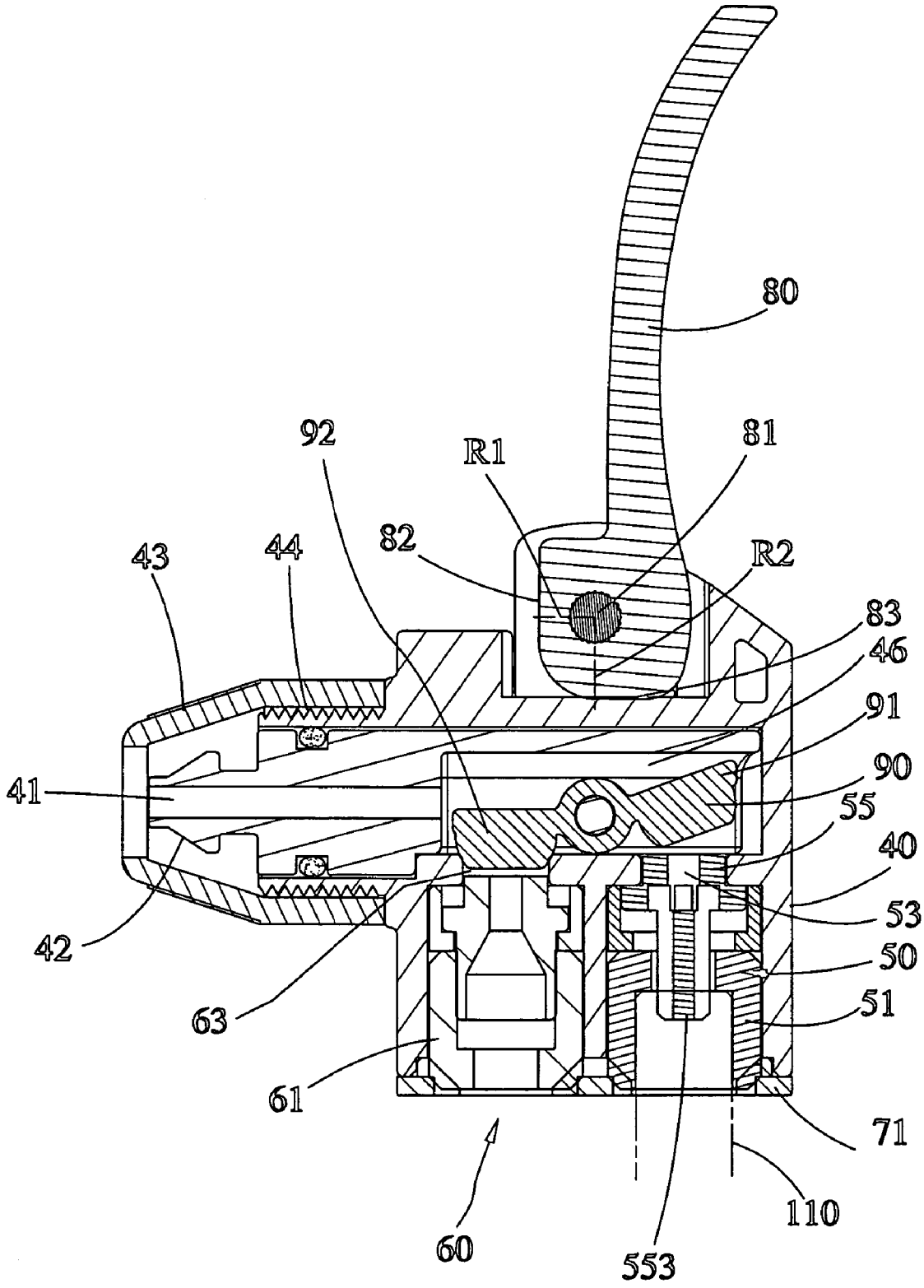
FIG. 6 and FIG. 7 are sectional views of the preferred embodiment of the present invention, showing the valve connector in operation.

A switching device 90 is received in the guiding room 46 and pivoted on a sidewall of the guiding room 46. The switching device 90 has two arms 91 and 92 at opposite sides of a pivot axle 93, which are not parallel to each other, such that the switching device 90 works like a lever. The switching device 90 is swung to seal the aperture 53 or 63 by the arm 91 or 92 so as to close the tunnel 52 or 62. In the present invention, the arm 91 is moved to the aperture 53, and the arm 92 is move distal to the aperture 63 when the switching device 90 is leaned, such that the aperture 53 is sealed and the aperture 63 is exposed, as shown in FIG. 4. On the contrary, when the switching device 90 is leaned to the other side, the aperture 63 is sealed by the arm 92 and the aperture 53 is exposed, as shown in FIG. 6.

In the present invention, the case 40 is provided with a latitudinal slot 401 and two longitudinal slots 402, 403 communicated with the latitudinal slot 401. A body member 47 with the plug 42 at an end thereof and with the channel 41 and the guiding room 46 therein is received in the latitudinal slot 401. The channel 41 extends through the plug 42. The pivot axle 93 is received in the guiding room 46.

The connector assemblies 50, 60 are a Schrader valve connector 50 and a Presta valve connector 60. The Schrader valve connector 50 includes an elastic barrel 51, a stop device 54 and a pushing device 55. The pushing device 55 is provided in the slot 402 first with a body 551 in the aperture 53 between the slot 402 and slot 401, and an annular shoulder 552 to be stopped by an inner top sidewall 404 of the slot 402, and a valve needle 553 at an end thereof. The tunnel 52 is formed in a center of the pushing device 55. The stop device 54 is provided in the slot 402 after the pushing device 55 with an annular sidewall 541 and a shoulder 542 at an end thereof When the stop device 54 touches the inner top sidewall 404 of the slot 402, there will be a gap 543 between the shoulder 542 and the inner top sidewall 404 to restrict the reciprocation of the pushing device 55 in the gap 543. The barrel 51 is provided in the slot 402 at last. The Presta valve connector 60 includes an elastic barrel 61, a stop device 64 and a pushing 65, which is similar to the Schrader valve connector 50 but with a different spec.

Although the present invention has a different way to compress the elastic barrels 51 and 61 than the conventional valve connectors, but the lever-type auto-switching device of the present invention may be incorporated in the conventional valve connectors directly.

Figure 1:
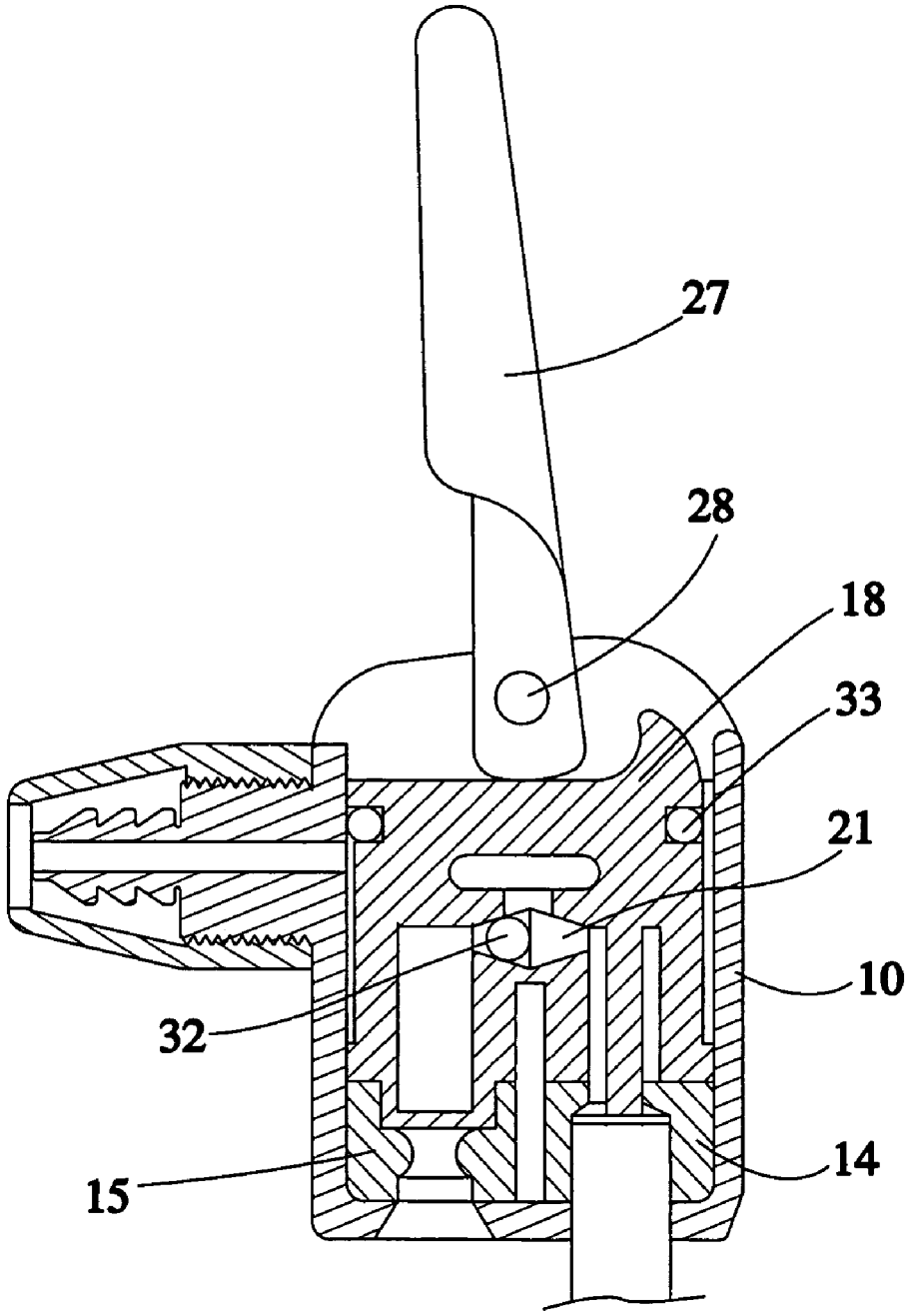
FIG. 1 PRIOR ART
FIG. 1 is a sectional view of the conventional double-channel valve connector.

The present invention further includes a pressing device 70, which has a bottom 71, two parallel arms 72 projected from opposite sides of the bottom 71 (FIG. 1 and FIG. 5). The case 40 is received in the arms 72 of the pressing device 70. A lever 80 is pivoted on the arms 72 of the pressing device 70 by a pin 81. The lever 80 is above the case 40 to restrict it. The case 40 is provided with two slots 45 on opposite sides, in which the arms 72 of the pressing device 70 are received respectively to guide the movement of the pressing device 70. The lever 80 has a first cam portion 82 and a second cam portion 83, wherein a distance R1 between the first cam portion 82 and the pin 81 is shorter than a distance R2 between the second cam portion 83 and the pin 81. As shown in FIG. 4, in the unused condition, the bottom 71 of the pressing device 70 presses the elastic barrels 51 and 61, and the first cam portion 82 of the lever 80 presses a bottom 407 of a recess 406 on a top of the case 40. The pressing device 70 is provided with two bores 73 and 74 on the bottom 71 associated with the barrels 51 and 61 respectively, in each of which a guiding rings 75, 76 is provided. The guiding rings 75, 76 have coned surfaces 751 and 761 to fit coned surfaces 511 and 611 of the barrels 51, 61 respectively.

In use, as shown in FIG. 6, when a Schrader valve 110 is inserted into the Schrader valve connector 50 with a needle 553 of the pressing device 55 being moved upwards by the valve 110, the needle 553 moves the arm 91 of the switching device 90 upwards to open the aperture 53, in the meantime, the arm 92 on the other side of the switching device 90 is moved downwards to close the aperture 63. Then, the lever 80 is swung from the position shown in FIG. 4 to the position shown in FIG. 6 to have the second cam portion 83 of the lever 80 pressing the case 40 and the bottom 71 of the pressing device 70 moving toward the case 40 and resting on it, such that the elastic barrels 51 and 61 are compressed to hold the Schrader valve 110 for inflation.

Figure 7:
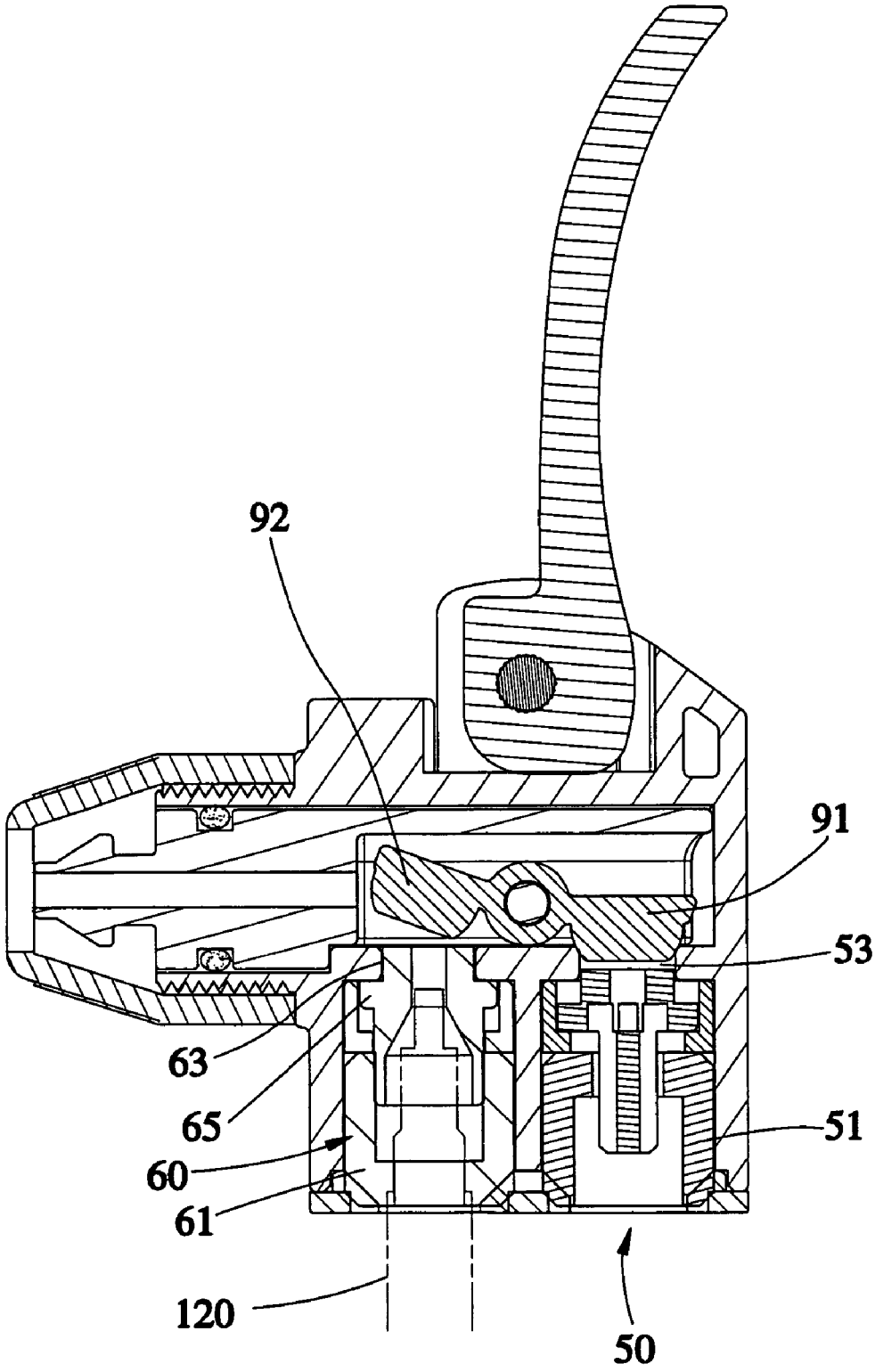

FIG. 7 shows a Presta valve 120 inserted into the Presta valve connector 60, in which the pressing device 65 is moved upwards to move the arm 92, such that the aperture 63 is opened and the aperture 53 is closed by the other arm 91. Then, the lever 80 is swung upwards to compress the barrels 51 and 61 to hold the Presta valve 120.

After inflation, the lever 80 is swung downward with the first cam portion 82 thereof pressing the case 40, such that the barrel 51 and 61 are not compressed to release the valve in the valve connector.

The present invention provides the switching structure with a lever device to replace the ball of the conventional device. It has a simple structure and reliable operation.

What is claimed is:

1. A valve connector of an air pump, comprising:

a case having a channel and a guiding room therein, wherein the channel is communicated with the guiding room;

two valve connector assemblies provided in the case, each of which has a tunnel communicated with the guiding room, wherein the tunnels form apertures on a sidewall of the guiding room; and a switching device received in the guiding room and pivoted on the sidewall of the guiding room, wherein the switching device has two arms on opposite sides of a pivot axle thereof, the arms moved toward or away from the apertures respectively when the switching device is swung to close or open the apertures;

wherein the case has two slots, and each of the valve connector assemblies has an elastic barrel, a stop device and a pushing device received in the slot in sequence.

2. The valve connector as defined in claim 1, wherein the arms are not parallel to each other to open or close the apertures respectively when the switching device is swung.

3. The valve connector as defined in claim 1, wherein there is a gap between the stop device and an inner top wall of the slot of the case for reciprocation of the pushing device.

4. The valve connector as defined in claim 1, further compressing a pressing device having a bottom and two parallel arms, wherein the case is received between the arms of the pressing device, and a lever pivoted on the arms by a pin.

5. The valve connector as defined in claim 4, wherein the lever has a first cam portion and a second cam portion, and a distance between the first cam portion and the pivot axle is shorter than that between the second cam portion and the pivot axle.

6. The valve connector as defined in claim 5, wherein a guiding slot is provided on the case or the pressing device to guide a relative movement between the case and the pressing device.

7. The valve connector as defined in claim 6, wherein the case is provided with two of the guiding slots and the arms of the pressing device are received in the guiding slots respectively.

8. The valve connector as defined in claim 4, wherein the pressing device has two bores associated with the valve connector assemblies respectively.

9. The valve connector as defined in claim 1, further compressing a pressing device having a bottom and two parallel arms, wherein the case is received between the arms of the pressing device, and a lever pivoted on the arms by a pin, wherein the pressing device has two bores associated with the valve connector assemblies respectively, in each of which a guiding ring is provided having a coned surface to fit the elastic barrel.

* * * * *